United States Patent [19]

Faulkner, III et al.

[11] Patent Number: 4,602,741

[45] Date of Patent: Jul. 29, 1986

[54] MULTI-ORIFICE NOZZLE ASSEMBLY

[75] Inventors: W. Harrison Faulkner, III; James M. Pagnella, both of Pacific Grove, Calif.

[73] Assignee: Slautterback Corporation, Monterey, Calif.

[21] Appl. No.: 704,892

[22] Filed: Feb. 22, 1985

Related U.S. Application Data

[63] Continuation of Ser. No. 493,710, May 11, 1983, abandoned.

[51] Int. Cl.[4] ..... B05B 1/24

[52] U.S. Cl. ..... 239/135; 222/146.2; 425/549

[58] Field of Search ..... 239/132–135; 118/410–412, DIG. 3; 222/146.1, 146.2, 146.5; 126/234, 284; 425/549, 550; 219/421; 137/341

[56] References Cited

U.S. PATENT DOCUMENTS

| | | | |
|---|---|---|---|
| 2,100,342 | 11/1934 | MacKenzie . | |
| 3,078,824 | 4/1960 | Bechle | 118/410 |
| 3,126,574 | 3/1964 | Fox | 15/580 |
| 3,212,715 | 10/1965 | Cocks | 239/125 |
| 3,344,767 | 10/1967 | Talarico | 118/411 X |
| 3,348,520 | 10/1967 | Lockwood | 118/411 X |
| 3,585,361 | 6/1971 | Rosen | 219/421 |
| 3,608,793 | 9/1971 | VanLobenSels | 118/411 X |
| 3,722,821 | 3/1973 | Jaeger et al. | 239/133 |
| 3,931,788 | 1/1976 | Gadd et al. | 118/411 X |
| 3,981,123 | 9/1976 | Flanagan | 118/DIG. 3 X |
| 4,287,408 | 9/1981 | Wilson | 219/421 X |
| 4,334,637 | 6/1982 | Baker et al. | 222/146.2 |
| 4,373,132 | 2/1983 | Vartanian | 219/421 |

*Primary Examiner*—Johnny D. Cherry
*Assistant Examiner*—Kevin Patrick Weldon
*Attorney, Agent, or Firm*—Thomas Schneck

[57] ABSTRACT

A nozzle assembly for a hot-melt dispensing head having a heat transfer block from the head to a manifold. The manifold includes a passageway for hot-melt with plural, spaced apart nozzle inserts for dispensing hot-melt. In one configuration the nozzle assembly has a T-shape with the nozzle inserts on a side of the T-top distal to the dispenser head. In another configuration, the nozzle assembly has a Y-shape with the nozzle inserts on a side of the Y-top facing the dispenser head. The two configurations may be spaced opposite each other to form a box sealing station.

2 Claims, 9 Drawing Figures

MULTI-ORIFICE NOZZLE ASSEMBLY

This is a continuation of application Ser. No. 493,710 filed on 5/11/83, and abandoned on Feb. 25, 1985.

TECHNICAL FIELD

The invention relates to a nozzle assembly for a hot melt adhesive dispenser and more particularly to a multi-orifice nozzle assembly for the low pressure dispensing of hot melt adhesive.

BACKGROUND ART

Hot melt adhesives are used in the automated packaging industry for sealing cases and cartons. Usually the viscous melted adhesive is extruded under high pressure through a nozzle having a small volume capacity to eliminate problems of tailing, drooling and stringing between applications. A typical hot melt adhesive extruder of the prior art, employing pressure to supply the adhesive, is that of U.S. Pat. No. 3,585,361. The use of high pressure to force the adhesive through the smaller capacity nozzle orifices presents an occupational risk to workers, as well as the expense of pressure resistant hoses, fittings and couplings which may be eliminated if nozzle performance, using low pressure applicating equipment, could equal that produced with the high pressure equipment. The use of larger orifices on the nozzles for lower pressure equipment would eliminate the problems of clogging with char particles from degraded adhesive found in the capillary nozzles, which necessitates use of filters with the high pressure apparatus. However, the larger diameter orifices may cause problems of drooling from the nozzle tips between applications because of the large volume of adhesive material past the cut-off valve. Decreasing the size of the bore of the passageway supplying adhesive to the nozzle tip would interfere with adequate adhesive flow under low pressure conditions. Prior art devices have employed the use of minimum reservoir spaces and small ports, in which capillary action causes the adhesive to return to a distributing passageway from the discharge port when the valve is closed, as in U.S. Pat. No. 3,126,574. However, this type of port sometimes delivers blobs of glue rather than continuous strips. In U.S. Pat. No. 3,078,824, the nozzle orifice itself is closed by a valve to minimize dripping from the nozzle when delivery of the adhesive is stopped. In. U.S. Pat. No. 2,100,342, the nozzle has a resilient tip portion having an open-ended compartment in the flat tip, into which glue is delivered through minute passages from a reservoir in the body of the nozzle. Any adhesive left in the open compartment, after delivery of the adhesive to the nozzle is stopped, is removed from the open-ended compartment on the tip by allowing it to harden and then distorting the flexible tip end thereby breaking away the hardened adhesive.

None of these nozzles taught by the prior art are useful for the precise application of hot melt adhesive in strip formation from a multi-orifice nozzle assembly to carton or cases under automated assembly line conditions.

An object of the invention was to devise a multi-orifice nozzle assembly that could be used with low pressure hot melt adhesive dispensers and that would maintain clean nozzle cut-off between applications without drips, drools, or leaks from the nozzle tip.

DISCLOSURE OF INVENTION

This object was met by the development of a multi-orifice nozzle manifold assembly, which could be attached directly to a low pressure hot melt dispensing head similar to the type shown in U.S. Pat. No. 3,212,715, which contains heaters, a pumping mechanism and valves for delivering hot melt material into the nozzle assembly. The multi-orifice nozzle assembly of the present invention features a heat transfer block connecting the nozzles to the hot dispenser head, by which means the melted adhesive is kept in a flowing condition. The diameter of the passageway for the adhesive through the manifold to the nozzles is kept to a critical size to allow adequate adhesive flow while preventing nozzle drool during cut-off periods. The nozzle is designed with inserts having orifices with extended tips which act as wicks to contain excess adhesive until the next application. Interspersed between the nozzle tips are steel wear bars which prevent direct contact of the nozzle orifices with the application surface while minimizing the chances for stringing of the adhesive caused by larger distance of the nozzle from the surface during application. The design of the invention allows use of larger orifices on the nozzle tips, thereby eliminating problems of clogging and need for filters to remove char particles.

BEST MODE FOR CARRYING OUT THE INVENTION

The present invention for the dispensing of hot melt adhesive material is a nozzle manifold assembly having nozzles of larger orifice diameter and extended tapered ends located on a dispensing bar with both material and heat conducting paths to a heated low pressure hot-melt dispenser head. The nozzle assembly is designed to ensure that sufficient flow of the adhesive is maintained under low pressure delivery conditions of below 150 pounds per square inch, while preventing the tendency of melted adhesive to drool from the larger diameter orifice in the nozzle tips.

Figure 1:
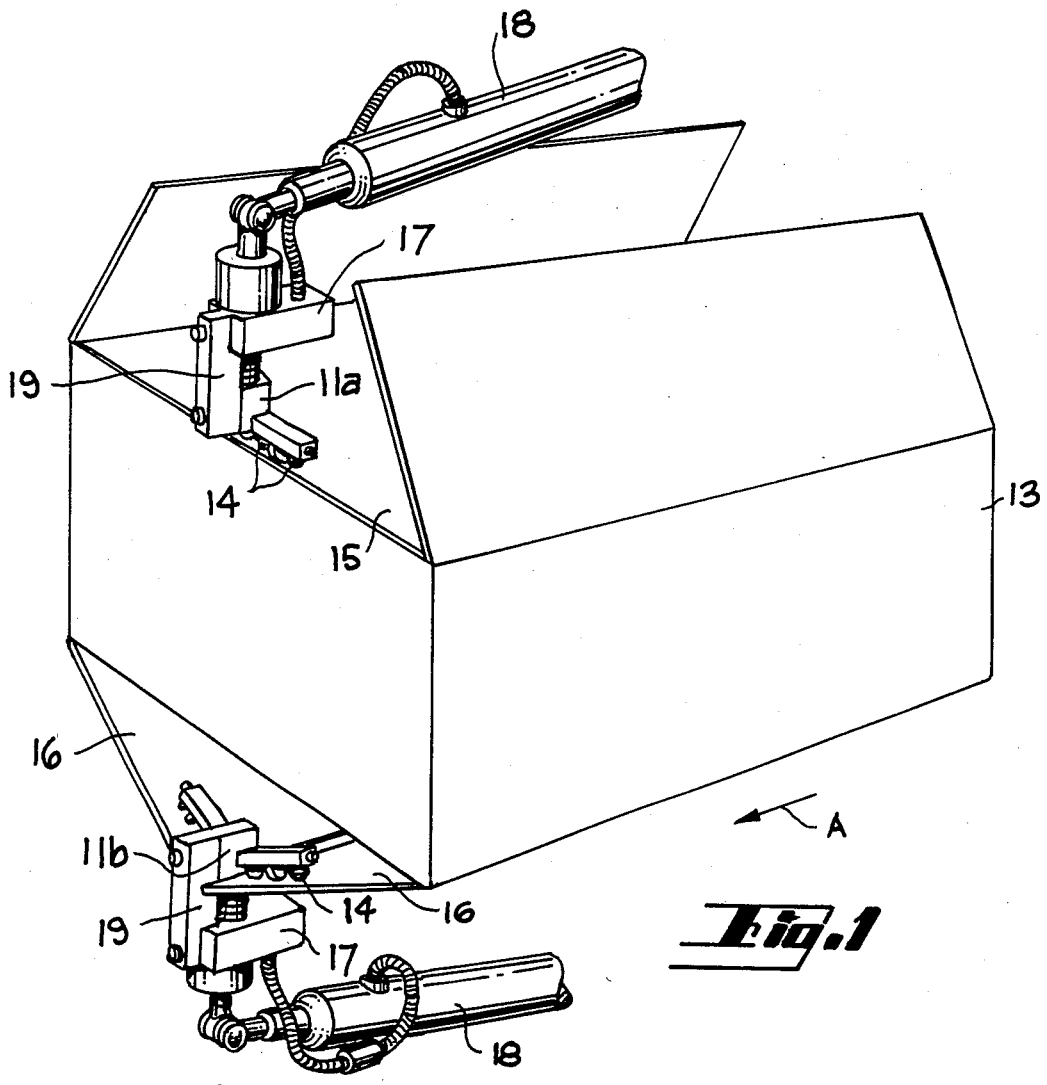
FIG. 1 is a perspective view showing the apparatus of the present invention in a carton sealing configuration for the application of hot melt adhesive to carton flaps by using two nozzle manifolds.
Figure 2:
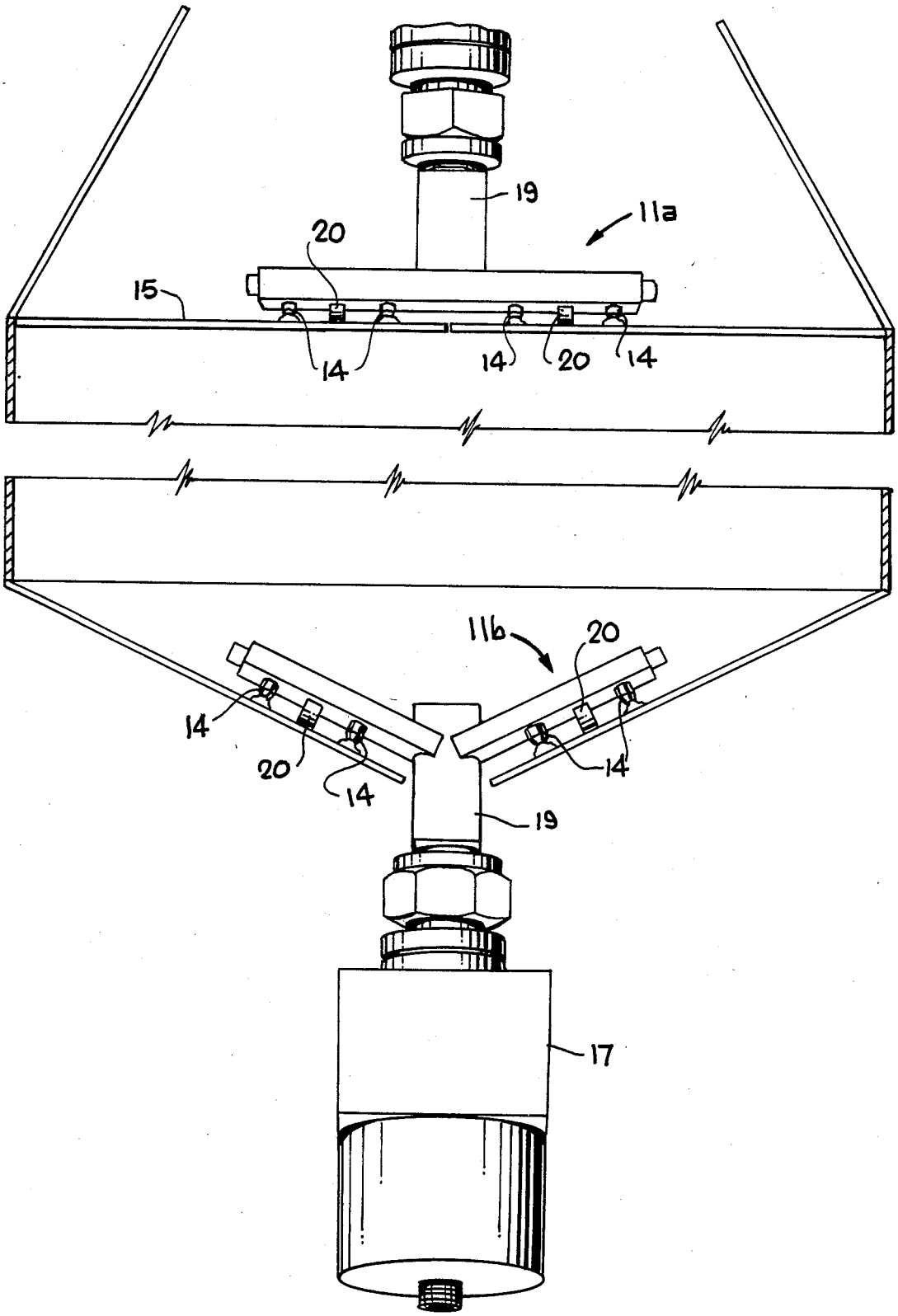
FIG. 2 is a close-up end view of the apparatus of FIG. 1.

With reference to FIGS. 1 and 2, two embodiments of the nozzle manifold assembly 11*a* and 11*b* of the present invention are shown in use in an automatic packaging assembly line. As a carton 13 moves along rollers (not shown) in the direction of the arrow A, hot melt adhesive is dispensed from the nozzles 14 to the outside surfaces 15 of the top minor flaps of the box and to the inside surfaces 16 of the bottom major flaps.

The nozzle manifolds are attached to fixed position heated hot melt dispenser heads 17 through which hot melt adhesive passes by means of solenoid valves from heated hoses 18 connected to melting tanks, not shown. Heat transfer blocks 19 conduct heat from the heated dispenser heads 17 to the nozzle manifolds.

In FIG. 2 the top-apply manifold assembly 11*a* is shown as an inverted T-shape configuration with the nozzles 14 placed on the side away from the dispensing head. The bottom apply manifold assembly 11*b* is of a Y-shape with the nozzles 14 facing toward the dispenser head 17, thus facilitating contact with the inner surface of the bottom major flaps of the box. FIG. 2 shows that direct contact of the box surface with the adhesive dispensing nozzle 14 is prevented by interspersed semi-circular wear bars 20, which ride along the box surface.

Figure 3:
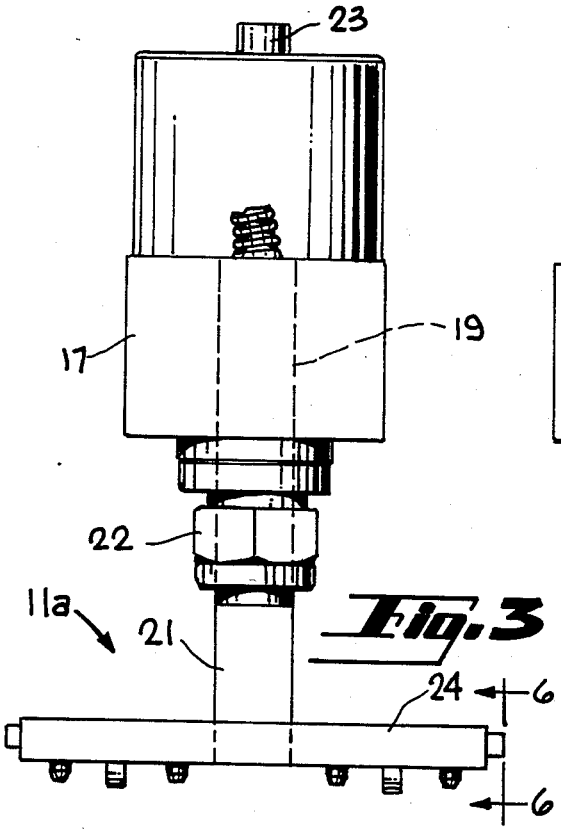
FIG. 3 is a plan view of the upper nozzle manifold of FIG. 2.
Figure 4:
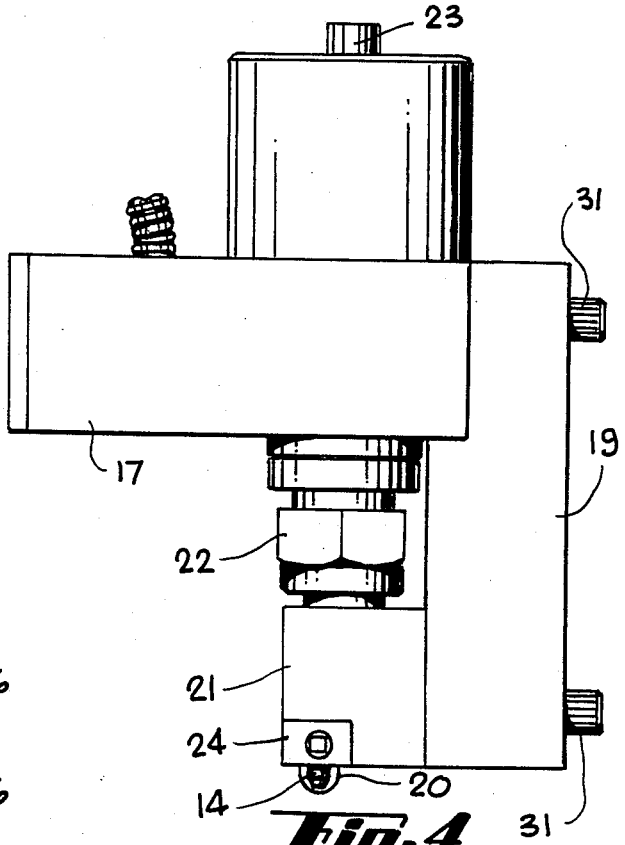
FIG. 4 is a side view of the manifold of FIG. 3.

FIGS. 3 and 4 show details of the connections between the dispenser head 17 and the nozzle manifold assembly 11*a*. An inlet section of the manifold 21, having a 0.089 inch diameter hollow center bore, not shown, is joined to the dispenser head by means of a swivel nut 22 in a direct hot melt material dispensing line with the inlet 23 of the dispensing head 17. The swivel nut 22 allows tolerances for a leak-free attachment of inlet section of the manifold to both the dispenser head 17 and to the heat transfer block 19, shown in phantom. The swivel nut and inlet section 21 are connected to the mid section of a rectangularly shaped dispensing bar 24, shown in lengthwise cross section in FIG. 7. The dispensing bar has an 0.089 inch inlet bore 25, which lines up with the center bore of the inlet section 21 and a longitudinal 0.089 inch inner bore 26, which opens to the outside through multiple 0.089 inch holes into which nozzle heads 14 are inserted with a braze connection. At both ends of the longitudinal inner bore 26, screws 27 are placed to facilitate cleaning of the nozzle manifold interior. Interspersed between the nozzles on the dispensing bar are brazed on semi-circular wear bars 20.

An important element of the nozzle manifold assembly is shown in FIG. 4. In order to maintain the adhesive in a less viscous melted condition which may be dispensed under lower pressure, it is necessary to minimize any cooling during the passage of the hot adhesive through the manifold. In addition, during periods between application, when the adhesive is held in the manifold, it is necessary to maintain it in a heated condition. To accomplish this purpose, a high heat conductivity metal block 19, such as aluminum, is placed in heat conducting relationship between the heated dispenser head 17 and the brass of the nozzle manifold inlet section 21. Connection is made to both the head and the inlet by two screws 31 in screw holes through the block. Any variation in tolerances of size of the interconnected heat transfer block and inlet section is adjusted by the swivel connection 22 of the inlet section 21 to the heated dispenser head 17, as previously described.

Figure 5:
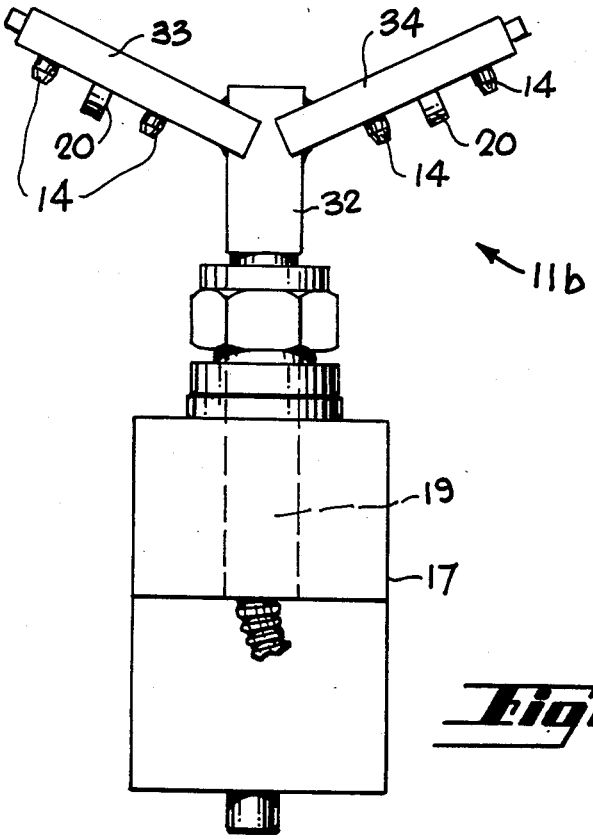
FIG. 5 is a plan view of the lower nozzle manifold of FIG. 2.

Another nozzle manifold assembly for use in applying adhesive to the inner edges of the major flaps at the bottom of a container is shown in FIG. 5. The dispenser bar of this Y-shaped applicator assembly is split into two sections and joined to an inlet section 32, which has a hollow 0.089 inch diameter center bore in material transfer relationship with the dispenser head, 17. The center bore diverges into two bores separated by angles of usually 110° or 130°. Each of the two sections of the dispensing bar 33 and 34 are joined at one of the two outlets of the diverging bores of inlet section 32. Center bores of 0.089 inch in each bar section continue the passageway for the melted adhesive to flow out of the nozzles 14 placed on the side of the dispenser bars facing toward the dispenser head. By this arrangement, melted adhesive may be applied to the inside edges of the partially opened bottom major flaps of the container. This embodiment has similar nozzle inserts and wear bars as previously described for the top-apply nozzle manifold assembly.

The material used for the nozzles 14 should be of a similar quality to oil hardenable drill rod for long wearing durability. The swivel nut connection piece, inlet section and dispensing bar may be fashioned from brass. Braze connections join the nozzle inserts and wear pieces to the dispensing bars and join the dispensing bars to the inlet sections. In this manner, a leak-free nozzle manifold is achieved.

Each nozzle assembly may be used independently or the top-apply and bottom apply embodiments may be combined as shown in FIG. 1 in an automated assembly line for sealing boxes. As the boxes pass down a conveyor belt the bottom outside flaps are folded partially and the top inside minor flaps are folded in. As the box moves along, it is contacted by the stationary mounted top apply and bottom apply nozzle assemblies. Hot-melt adhesive is dispensed from the nozzle tips, falling on the flaps in parallel strips. It is possible to control the length of the strips by a valving mechanism in the dispenser head so as to deposit short or long strips or dots adhesive. Since the nozzle tips do not contact the box surface directly, tailing caused by dragging of the nozzle tip in the applied adhesive is lessened. Any adhesive left on the nozzle tip wicks up and is retained until the next application.

Figure 6:
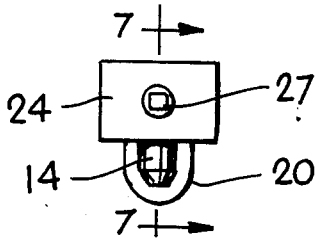
FIG. 6 is an end view of a dispensing manifold taken along lines 6—6 of FIG. 3.
Figure 7:
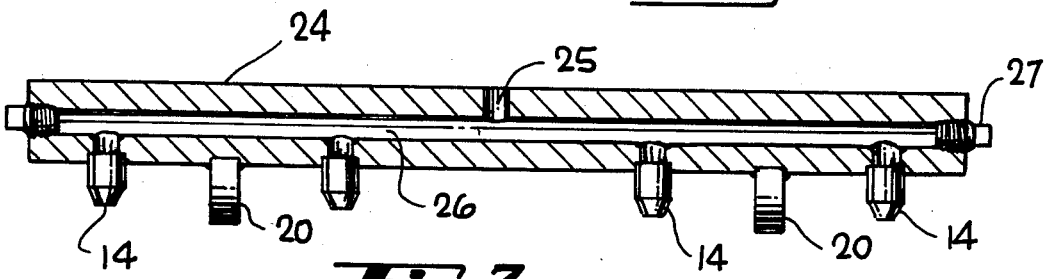
FIG. 7 is a cross section of a dispensing manifold taken along lines 7—7 of FIG. 6.

FIGS. 6 and 7 show the size relationship between the wear bars and the nozzles, by which means direct contact of the nozzle with the application surface of a container is prevented. Such contact would damage the nozzle tips by abrasion. By means of a wear bar, a nozzle is brought close to an application surface without touching. This closeness minimizes the stringing, which happens when slightly cooled adhesive is drawn by the nozzle tip from the adhesive applied to the carton flap. Any strings which do develop are short and adhere to the carton flap instead of producing mounds of thousands of long adhesive strings building up over a period of time. FIG. 6 also shows the rectangular shape of the dispensing bar 24. This shape gives the dispensing bar maximum strength while providing a minimization of radiation surface between the surrounding air and the hot-melt-adhesive-containing bores. The diameter passageway through this dispensing bar is preferably 0.089 inch, a dimension found to be important. Smaller diameters would not permit an adequate adhesive flow under low pressure delivery conditions. A larger diameter would result in poor cutoff of adhesive flow and increase the tendency of the nozzle to drool.

Figure 9:
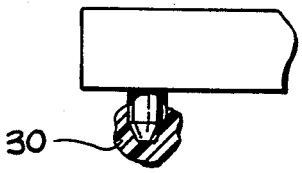
FIG. 9 is a front view of a dispensing manifold and nozzle insert.
Figure 8:
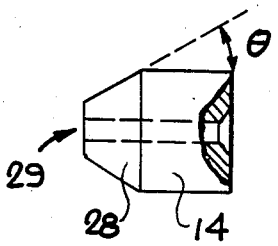
FIG. 8 is a partial cut-away view of a nozzle insert.

The chance of any drooling of hot adhesive from the nozzle between applications, produced by the presence of large volumes of adhesive past the valving section, is lessened by the extended taper design of the nozzle inserts as shown in FIG. 8. For small nozzle orifice diameters of 0.020 inch, the angle $\theta$ of the taper is about 28° and the lip diameter 29 is 0.050 inch. For a larger orifice diameter of 0.090 inch, the taper angle is 4.4° and the lip diameter is 0.120 inch. This larger lip diameter of the wider orifice nozzle provides a wick which holds on to larger drops of drooling adhesive, preventing their dropping off. The small lip diameter and greater angle of the small orifice nozzle inserts, allows the smaller drops to adhere to each other along the taper, thereby preventing dropping off. Such a wicking action is shown in FIG. 9, in which the drooling adhesive is caught on the taper surface of the nozzle insert.

The nozzle system of the present invention thus permits dispensing of hot melt adhesive at low pressures, 150 psi and lower, because the critical size of the bore of the dispenser bars prevents drooling from the larger nozzle insert orifices which are required for lower pressure dispensing while maintaining an adequate flow. Any material which does drip between applications is caught by the wicking action of the nozzle insert tips. Material is retained in a melted condition between applications by the contact of the heat transfer bar with the heated dispenser head.

We claim:

1. In an automated assembly line for the hot-melt adhesive sealing of cartons, in which the adhesive is dispensed from a heated dispenser head, the improvement which comprises, a multi-orifice nozzle manifold assembly means connected to a hot-melt dispenser head having nozzles operable at low pressure and having an inverted T-shape with a top and a base, the nozzles on a side of the T-top distal to the dispenser head for applying hot-melt to the top minor flaps of a carton and a second multi-orifice nozzle manifold assembly means connected to said hot-melt dispenser head having nozzles operable at low pressure and having a Y-shape with a top and a base, the nozzles on a side of the Y-top facing the dispenser head for applying hot-melt to the inside of the bottom major flaps of a carton, each nozzle manifold in heat transfer contact with a passive high heat conductivity metal block, and a heated hot-melt dispenser head connected to the metal block in heat transfer relation, the metal block providing a heat flow path distinct from said manifold from said heated dispenser head to each nozzle manifold.

2. An improved nozzle system for the sealing of the top and bottom major and minor flaps of a moving container, with hot-melt adhesive material of the type wherein said material is dispensed through an applicator nozzle from a heated holding tank by means of a remote controlled valving mechanism on a heated dispenser head wherein the improvement comprises, a stationary multi-orifice nozzle manifold having an inverted T-configuration with a top and a base and with nozzles on a side of the T-top distal to the dispenser head for low pressure application of adhesive material to the outside of the top minor flaps of the moving container and a second stationary multi-orifice nozzle means having a Y-configuration with a top and a base and with nozzles on a side of the Y-top facing the dispenser head for simultaneous low pressure application of adhesive material to the inside of the bottom major flaps of the moving container, said nozzle manifold in heat transfer contact with a passive high heat conductivity metal block, and a heated hot-melt dispenser head connected to the metal block in heat transfer relation, the metal block providing a heat flow path distinct from said manifold from said heated dispenser head to said nozzle manifold.

* * * * *